US008395310B2

(12) United States Patent
Li

(10) Patent No.: US 8,395,310 B2
(45) Date of Patent: Mar. 12, 2013

(54) METHOD AND APPARATUS FOR PROVIDING OMNIDIRECTIONAL ILLUMINATION USING LED LIGHTING

(75) Inventor: Jianhua Li, Livermore, CA (US)

(73) Assignee: Bridgelux, Inc., Livermore, CA (US)

( * ) Notice: Subject to any disclaimer, the term of this patent is extended or adjusted under 35 U.S.C. 154(b) by 0 days.

(21) Appl. No.: 13/049,157

(22) Filed: Mar. 16, 2011

(65) Prior Publication Data

US 2011/0169431 A1 Jul. 14, 2011

(51) Int. Cl.
*F21V 7/10* (2006.01)
*F21V 29/00* (2006.01)
*H05B 37/00* (2006.01)

(52) U.S. Cl. ..... 313/498; 313/113; 313/46; 362/183

(58) Field of Classification Search ..... 313/498–512; 445/24–25

See application file for complete search history.

(56) References Cited

U.S. PATENT DOCUMENTS

| | | | | |
|---|---|---|---|---|
| 7,744,246 | B2 * | 6/2010 | Rizkin et al. | 362/245 |
| 2002/0163808 | A1 * | 11/2002 | West et al. | 362/255 |
| 2010/0213835 | A1 * | 8/2010 | Mo et al. | 313/512 |
| 2011/0080096 | A1 * | 4/2011 | Dudik et al. | 315/112 |
| 2011/0080740 | A1 * | 4/2011 | Allen et al. | 362/294 |
| 2011/0080742 | A1 * | 4/2011 | Allen et al. | 362/294 |
| 2011/0215696 | A1 * | 9/2011 | Tong et al. | 313/46 |

* cited by examiner

*Primary Examiner* — Tracie Y Green

(57) ABSTRACT

A light-emitting device capable of generating omnidirectional light utilizing a reflector is disclosed. The light-emitting device, in one aspect, includes a light emitting diode ("LED") package, a light reflector, and a shell. The LED package, which is mounted on a plate, generates a forward light cone by converting electrical energy to optical energy. The light reflector can be formed with various different shapes that can be placed adjacent to the LED package. A function of the light reflector is to redistribute at least a portion of the forward light cone whereby the overall light illuminated by the light-emitting device complies with LM79 specifications. The shell is used to enclose the LED package and the light reflector and configured to illuminate light in omnidirectional radiation in response to the forward light cone.

20 Claims, 14 Drawing Sheets

METHOD AND APPARATUS FOR PROVIDING OMNIDIRECTIONAL ILLUMINATION USING LED LIGHTING

FIELD

The exemplary aspect(s) of the present invention relates to lighting devices. More specifically, the aspect(s) of the present invention relates to light radiation emitted by a solid-state light apparatus using light-emitting diode ("LED") device.

BACKGROUND

With increasing efficiencies and capabilities in solid-state lighting technology, solid-state light emitting devices such as LEDs are in a process of replacing traditional incandescent and/or fluorescent light bulbs for general illumination. LEDs typically have higher light conversion efficiencies and have longer lifetime than conventional light sources. With continuing development of LEDs, LEDs will have higher light conversion efficiencies and less energy consumption. For LEDs to be accepted to general lighting applications, it not only provides high energy conversion capability, but also adopts existing lighting standards and infrastructure. An advantage of using the LEDs for general illumination is that they are more energy efficient, compact, and reliable in comparison with traditional lighting fixtures such as incandescent or fluorescent light bulbs or lamps.

A drawback, however, associated with a typical LED lamp is that it usually delivers a directional light, also known as light forward or forward light cone. A reason that an LED lamp gives off light in one direction is that an LED lighting apparatus is a forward illuminating light source. However, under luminous flux measurement ("LM") 79 specifications, a typical lighting fixture such as incandescent lamps is required to deliver omnidirectional light and/or illumination.

SUMMARY

Aspect(s) of present invention discloses a sold-state light-emitting device which is capable of generating omnidirectional light using a reflector, a lens, or a light guide, or a combination of the above. The device, in one aspect, includes a light emitting diode ("LED") package, a light reflector (or a lens, and/or a light guide), and a shell. The LED package, which is mounted on a plate, generates a forward light cone by converting electrical energy to optical energy. The light reflector (or lens or light guide) can be formed with various different shapes that can be placed adjacent to the LED package. A function of the light reflector (or lens or light guide) is to redistribute light from at least a portion of the forward light cone to omnidirectional light. A shell is employed to provide protection to the LED package and the light reflector (or lens or light guide). In addition, the shell also assists and spreads directional light into omnidirectional radiation.

It is understood that other aspects of the present invention will become readily apparent to those skilled in the art from the following detailed description, wherein it is shown and described only exemplary configurations of an LED by way of illustration. As will be realized, the present invention includes other and different aspects and its several details are able to be modified in various other respects, all without departing from the spirit and scope of the present invention. Accordingly, the drawings and the detailed description are to be regarded as illustrative in nature.

BRIEF DESCRIPTION OF THE DRAWINGS

The exemplary aspect(s) of the present invention will be understood more fully from the detailed description given below and from the accompanying drawings of various aspects of the invention, which, however, should not be taken to limit the invention to the specific aspects, but are for explanation and understanding only.

DETAILED DESCRIPTION

Figure 1:
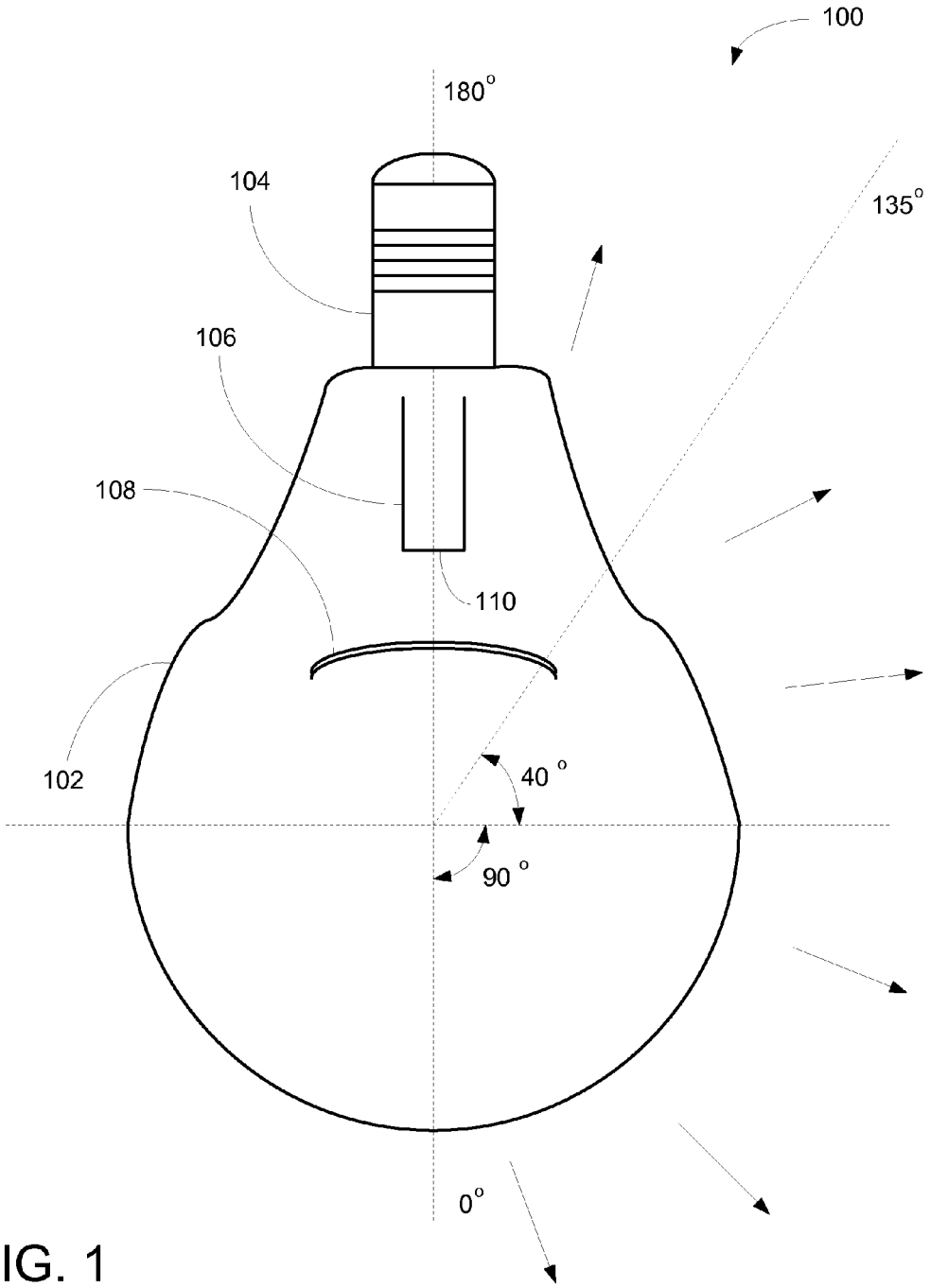
FIG. 1 is a diagram illustrating a solid-state lighting device having a reflector in accordance with one aspect of the present invention.

Aspects of the present invention is described herein in the context of a method, device, and apparatus of light emitting diode ("LED") devices capable of providing omnidirectional radiation for general illumination.

The present invention is described more fully hereinafter with reference to the accompanying drawings, in which various aspects of the present invention are shown. This invention, however, may be embodied in many different forms and should not be construed as limited to the various aspects of the present invention presented throughout this disclosure. Rather, these aspects are provided so that this disclosure is thorough and complete, and fully conveys the scope of the present invention to those skilled in the art. The various aspects of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

Various aspects of the present invention will be described herein with reference to drawings that are schematic illustrations of idealized configurations of the present invention. As such, variations from the shapes of the illustrations as a result, for example, manufacturing techniques and/or tolerances, are to be expected. Thus, the various aspects of the present invention presented throughout this disclosure should not be construed as limited to the particular shapes of elements (e.g., regions, layers, sections, substrates, etc.) illustrated and described herein but are to include deviations in shapes that result, for example, from manufacturing. By way of example, an element illustrated or described as a rectangle may have rounded or curved features and/or a gradient concentration at its edges rather than a discrete change from one element to another. Thus, the elements illustrated in the drawings are schematic in nature and their shapes are not intended to illustrate the precise shape of an element and are not intended to limit the scope of the present invention.

It will be understood that when an element such as a region, layer, section, substrate, or the like, is referred to as being "on" another element, it can be directly on the other element or intervening elements may also be present. In contrast, when an element is referred to as being "directly on" another element, there are no intervening elements present. It will be further understood that when an element is referred to as being "formed" on another element, it can be grown, deposited, etched, attached, connected, coupled, or otherwise prepared or fabricated on the other element or an intervening element.

Furthermore, relative terms, such as "lower" or "bottom" and "upper" or "top," may be used herein to describe one element's relationship to another element as illustrated in the drawings. It will be understood that relative terms are intended to encompass different orientations of an apparatus in addition to the orientation depicted in the drawings. By way of example, if an apparatus in the drawings is turned over, elements described as being on the "lower" side of other elements would then be oriented on the "upper" side of the other elements. The term "lower", can therefore, encompass both an orientation of "lower" and "upper," depending of the particular orientation of the apparatus. Similarly, if an apparatus in the drawing is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skills in the art to which this invention belongs. It will be further understood that terms, such as those defined in commonly used dictionaries, should be interpreted as having a meaning that is consistent with their meaning in the context of the relevant art and this disclosure.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items Various aspects of an LED luminaire will be presented. However, as those skilled in the art will readily understand, these aspects of invention may be extended to aspects of LED luminaries without departing from the invention. The LED luminaire may be configured as a direct replacement for conventional luminaries, including, by way of example, recessed lights, surface-mounted lights, pendant lights, sconces, cove lights, track lighting, under-cabinet lights, landscape or outdoor lights, flood lights, search lights, street lights, strobe lights, bay lights, strip lights, industrial lights, emergency lights, balanced arm lamps, accent lights, background lights, and other light fixtures.

As used herein, the term "light fixture" shell mean the outer shell or housing of a luminaire. The term "luminaire" shell mean a light fixture complete with a light source and other components (e.g., a fan for cooling the light source, a reflector for directing the light, etc.), if required. The term "LED luminaire" shell mean a luminaire with a light source comprising one or more LEDs. LEDs are well known in the art, and therefore, will only briefly be discussed to provide a complete description of the invention.

It is further understood that the aspect of the present invention may contain integrated circuits that are readily manufacturable using conventional semiconductor technologies, such as CMOS ("complementary metal-oxide semiconductor") technology, or other semiconductor manufacturing processes (this invention does not contain integrated circuits, CMOS, etc). In addition, the aspect of the present invention may be implemented with other manufacturing processes for making optical as well as electrical devices. Reference will now be made in detail to implementations of the exemplary aspect(s) as illustrated in the accompanying drawings. The same reference indicators will be used throughout the drawings and the following detailed description to refer to the same or like parts.

One aspect of presently disclosed invention discloses a solid-state light-emitting apparatus capable of generating omnidirectional light utilizing one or more light reflectors such as a lens or light guide. The apparatus includes at least one light emitting diode ("LED") package, one light reflector (i.e., a lens, and/or a light guide), and a shell. The LED package, which can be mounted on a plate, generates a forward directional light or forward light cone upon converting from electrical energy to optical photons. The light reflector (or lens or light guide) can be fabricated with various different shapes and can be placed adjacent to and/or in front of an LED package. A function of the light reflector (or lens or light guide) is to redistribute at least a portion of the forward light cone whereby the overall light illuminated by the light-emitting apparatus is omnidirectional. The shell provides impact protection to the LED package and light reflector (or lens or light guide) by enveloping the LED package and light reflector within the shell. The shell also provides a function of redistribute light from directional light to omnidirectional light.

FIG. 1 is a diagram illustrating a solid-state lighting device 100 having a reflector in accordance with one aspect of the present invention. Solid-state lighting device 100 includes a coupling element 104, a mount stage 106, a reflector 108, and a shell 102, wherein shell 102 encloses or envelops reflector 108 and mount stage 106. Mount stage 106, in one aspect, is also referred to as a tube capable of housing LEDs. Coupling element 104, in one example, includes a base or screw base that is able to fit and/or couple to a conventional lighting or lamp socket. The socket, not shown in FIG. 1, provides power supply such as electrical current to device 100. Other types of coupling mechanism such as a bayonet coupling base can be used to couple solid-state lighting device 100 to an existing lighting socket or fixture. It should be noted that the underlying concept of the exemplary aspect(s) of the present invention would not change if one or more elements (or devices) were added to or removed from device 100.

Mount stage 106, in one aspect, is configured to provide a substrate for solid-state light source. The solid-state light source is a semiconductor based light emitting devices such as LEDs. For example, an LED package is an assembly including one or more LED dies wherein each LED die can be considered as a solid-state semiconductor integrated circuit capable of converting electrical current to optical photons. An LED array includes an LED assembly having a printed circuit board ("PCB") containing multiple LED packages.

Mount stage 106 may be fabricated in a cylindrical column, square tube, hexagon tube, octagon shape, or the like. A function of mount stage 106 is to hold one or more LED packages to provide sufficient luminance in accordance with a predefined application. In one configuration, multiple LED light sources or packages are mounted on mount stage 106, wherein each LED package, for example, may be mounted on each side of mount stage 106 whereby the light generated by the LED packages is more evenly distributed. Top surface 110 of mount stage 106 can be flat, circular, spherical, partial spherical, curved, and/or cone shape. Top surface 110, in one aspect, is configured to hold additional LED packages for increasing illumination. Each LED package is configured to produce a forward light cone or a directional light by converting electrical energy to optical photons. A forward light cone, directional light, and/or light forward means a column of light traveling away from the LED.

Mount stage 106 may be made by various different types of materials such as metal, aluminum, copper, nickel, gold, silver, alloy, plastic, polymer, composite, or a combination of aluminum, copper, nickel, gold, silver, alloy, plastic, polymer, and/or composite. Depending on the applications, mount stage 106 is coated with white color or metallic reflective substance or coating to minimize shadows. The dimensions of mount stage 106 such as shape and length and anchoring location(s) of LED light sources may be adjusted and optimized to meet LM79 specifications for omnidirectional illumination.

Shell 102, which is also known as bulb shell, is used to enclose mount stage 106 and reflector 108. Shell 102 may be made of plastic, glass, polymer, composite, or a combination of plastic, glass, polymer and/or composite. A function of shell 102 is to assist or redistribute light from forward light cone to omnidirectional light. Depending on the applications, shell 102 is fabricated with transparency or semi-transparency milky (or white) color. Alternatively, shell 102 is coated with a transparent or semi-transparent white coating for facilitating redistribution of light from directional radiation to omnidirectional radiation. In addition to even redistribution of light, shell 102 also provides impact and/or contact protection for mount stage 106 and reflector 108.

Reflector 108, in one aspect, is a piece of apparatus having a polished or reflective surface capable of reflecting or deflecting light. Reflector 108 can be made of various types of materials, such as glass, metal, aluminum, copper, nickel, gold, silver, alloy, paper, plastic, polymer, composite, or a combination of glass, aluminum, copper, nickel, gold, silver, alloy, paper, plastic, polymer, and/or composite. Depending on applications, reflector 108 may be coated with white color and/or metallic reflective coating to increase reflection efficiency. In one configuration, an LED or an array of LED light sources sit on a plate, a reflector is remotely located in front of the LED. The reflector can be flat, curved, cone shape, or partial spherical shape to achieve desirable omnidirectional illumination. The dimension and shape of reflector 108 may be adjusted according to LM 79 specifications to achieve optimized illumination.

The term "omnidirectional light or radiation" refers to equal lighting sensitivity in almost all directions. Luminous flux (or LM) is the photometric power of a light source measured in lumens (lm), which implies total flux emitted in all directions. Measurement geometry requires a measurement of all luminous flux. To measure total luminous flux, light output over 360° of light collecting integrating spheres is detected, collected, and summed. According to LM79 specifications, an omnidirectional lighting apparatus or bulb should at least meet the following three requirements: (1) luminous intensity at any angle from 0° to 135° zone shall not differ from the mean intensity of the entire 0° to 135° zone by more than 20%; (2) at least 5% of total flux in 135°-180° zone; and (3) measurements repeated in vertical planes 45° and 90° from initial plane.

The LED package, for example, further includes a solid-state light emitter capable of converting electrical energy to optical photons. Device 100 further includes a post which is coupled to the plate. The post is configured to secure the light reflector in front of the LED. Alternatively, the post is configured to channel heat inside of the shell to a heat sink. The plate, for example, couples to an electrical driver and a heat sink. It should be noted that the forward light cone includes a column of light with angles travels away from the LED package.

Light reflector 108 is configured to be adjacent to the LED package and is able to redistribute at least a portion of the forward light cone from directional light to omnidirectional light. In one aspect, light reflector 108 is placed at a location which is at least partially on the path of a forward light cone. Note that light reflector 108 is made of metal materials coated with reflective coating. Shell 102 is configured to house the LED package and light reflector 108, and distribute omnidirectional radiation in response to the forward light cone. In addition to providing protection to the LED package and light reflector 108, shell 102 also facilitates redistribution of light from the forward light cone to omnidirectional light in accordance with specification of LM79.

Figure 2:
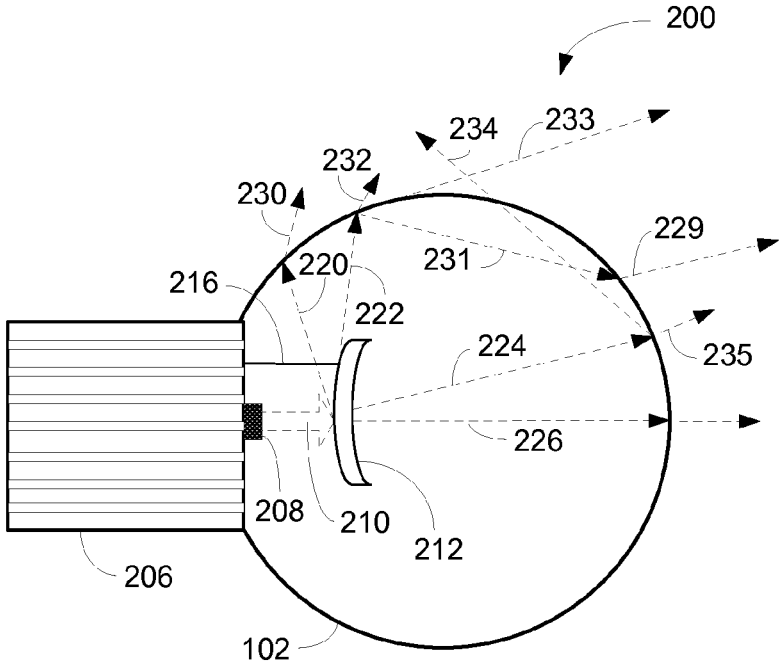
FIG. 2 illustrates side-view diagrams of lighting devices showing LED packages and reflectors in accordance with one aspect of the present invention.
Figure 2:
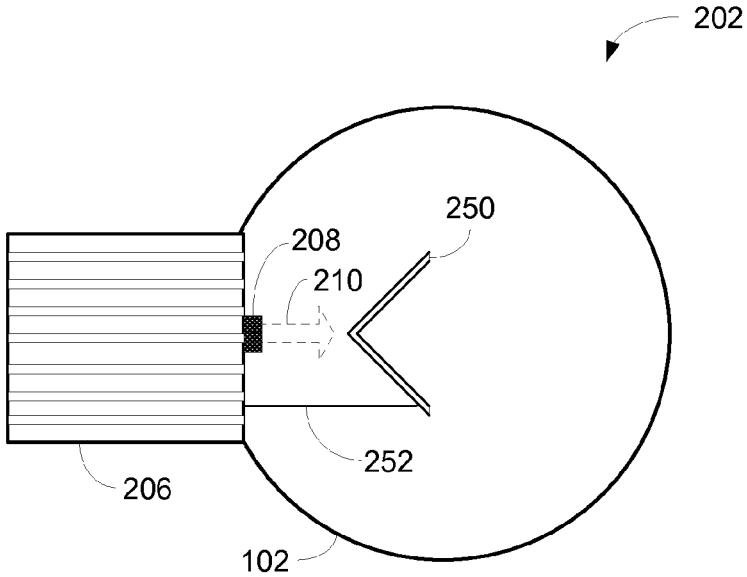

FIG. 2 illustrates side-view diagrams of lighting devices 200-202 showing LED packages and reflectors in accordance with one aspect of the present invention. Device 200 includes a heat sink 206, a shell 102, an LED package 208, a light reflector 212, and a post 216. Device 200 may include a base, not shown in FIG. 2, for coupling to a power supply. Depending on the configurations, additional post(s) can be used to anchor or secure light reflector 212 in a light path 210 emitted from LED package 208. It should be noted that the underlying concept of the exemplary aspect(s) of the present invention would not change if one or more elements (or devices) were added to or removed from device 200

LED package 208 is a solid-state light emitting assembly that is capable of including one or more LED dies. Each LED die includes a semiconductor P-N junction configured to convert electrical energy to optical light. When LED package 208 is connected to an electrical power supply, it generates light 210 going forward. Note that if LED package 208 contains more than one LED dies, LED package 208 may emit multiple beams or one combined beams.

Heat sink 206, in one aspect, includes various other elements and circuits such as a mount stage and an LED driver. While mount stage, as discussed above, may be used to house LED package 208, the LED driver manages power distribution in accordance with LED electrical characteristics. For example, heat sink 206 is configured to be hollow inside while various heat dissipating fins form on the outside surface of heat sink 206. While the hollow portion of heat sink 206 is able to house LED driver(s), a function of heat sink 206 is to dissipate heat inside shell 102 around LED package(s).

Light reflector 212, in one aspect, is configured to be in a curved shape which is anchored in a path of directional light 210 for redistributing or scattering light from the directional light to the omnidirectional light. Light reflector 212 is fixed or secured by post 216. The location of light reflector 212 can be adjusted to achieve generations of omnidirectional illumination in accordance with LM79. It should be noted that the shape and/or size of reflector 212 can be adjusted or optimized in response to generation of omnidirectional illumination.

During an operation, upon receipt of directional light 210 at reflector 212, a portion of light 226 which is not deflected passes through reflector 212 and travels to the inside surface of shell 102. A portion of light 226 exits device 200 when light 226 penetrates shell 102. Light 224 is slightly deflected after a portion of directional light 210 passes through reflector 212. When light 224 impacts the inside surface or wall of shell 102, it may split into multiple portions 234-235 to exit shell 102. Light beams 220-222 deflected at reflector 212 strike the inside surface or wall of shell 102, they are further split into multiple portions of light beams 229-233 to exist shell 102. Upon carefully rearranging, refining, adjusting, and manipulating optical beams 220-235, omnidirectional illumination can be achieved.

The surfaces of plate, mount stage (or tube), reflector 212, post 216, in one aspect, are coated with white or highly reflective substance. Shell 102 is made of materials having milky or white color which can be partially transparent and partially reflective. Shell 102, in one aspect, facilitates redistribution of light from directional light beams to omnidirectional light beams. It should be noted that other shape of shells or color of shells may be used to achieve omnidirectional illumination.

Device 202, in one aspect, includes a heat sink 206, a shell 102, an LED package 208, a light reflector 250, and a post 252. Device 202 also includes a base, not shown, for coupling to a traditional lighting socket. Depending on the configurations, additional post(s) can be used to anchor or secure light reflector 250 in the path of directional light 210 emitted from LED package 208. Device 202 is substantially similar to device 200 except that the shape of light reflector 250 is different. In one aspect, light reflector 250 is a cone shape anchored in the path of directional light 210 for redistributing or scattering light. One or more posts 252 are used to anchor or fix light reflector 250 to a location. The location of light reflector 250 can be adjusted to achieve optimal omnidirectional illumination. It should be noted that shape and size of reflector 250 can be adjusted or optimized to achieve omnidirectional radiation.

Post 252, in one example, is made of rigid materials such as metal, aluminum, copper, nickel, gold, silver, alloy, paper, plastic, polymer, composite, or a combination of aluminum, copper, nickel, gold, silver, alloy, paper, plastic, polymer, and/or composite. In one aspect, post 252 also functions as a heat dissipating apparatus capable of channeling or transferring heat from inside of shell 102 to heat sink 206. It should be noted that reflector 250 may require more than one post to anchor or secure at a desirable location.

Figure 3:
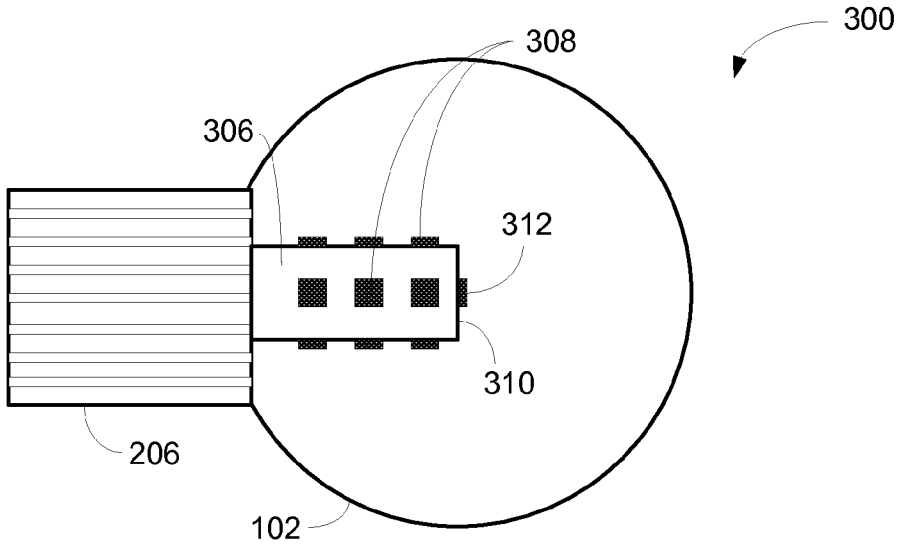
FIGS. 3-5 illustrate side-view diagrams of lighting devices capable of providing omnidirectional illumination using multiple LED packages in accordance with one aspect of the present invention.
Figure 3:
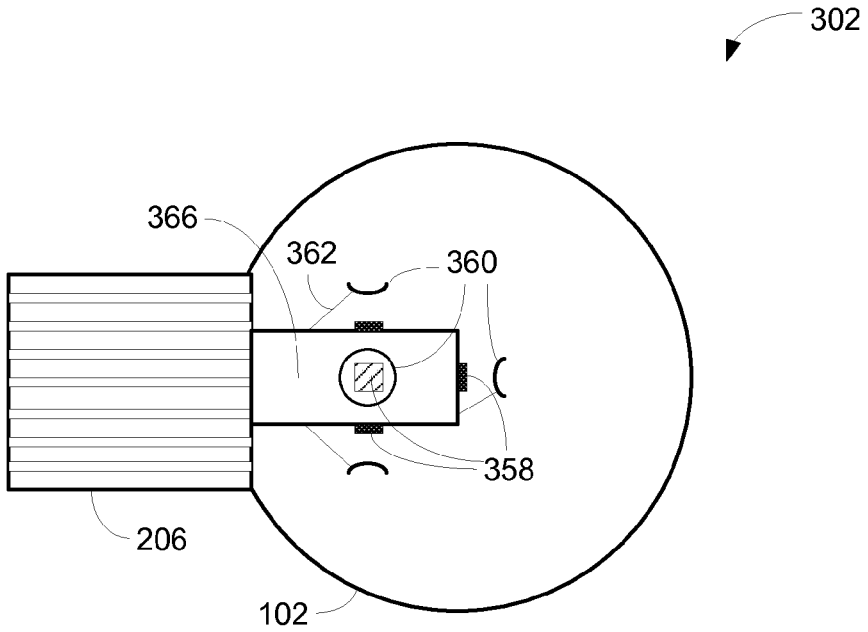

FIG. 3 illustrates side-view diagrams of lighting device 300-302 capable of providing omnidirectional illumination using multiple LED packages in accordance with one aspect of the present invention. Device 300 includes a heat sink 206, a shell 102, and a mount stage 306 wherein mount stage 306 is able to house multiple LED packages 308. Device 300 may include additional elements such as a base for coupling to a power supply. It should be noted that the underlying concept of the exemplary aspect(s) of the present invention would not change if one or more elements (or devices) were added to or removed from device 300.

To provide omnidirectional illumination, mount stage 306, in one aspect, is configured to house multiple LED packages 308 wherein every LED package 308 is arranged in such a way that combined directional light columns generated by LED packages 308 meet the requirements of omnidirectional illumination under the LM79. Depending on the applications and optimizations, mount stage 306, for instance, can be formed in different shapes such as cylindrical tube, square tube, hexagon tube, octagon shape, spherical shape, or the like. A function of mount stage 306 is to house sufficient number of LED packages to achieve sufficient luminance in all directions. In one configuration, top surface 310 of mount stage 306 is flat whereby an LED package 312 can be mounted to provide additional luminance. Top surface 310 can also be in different shape, such as circular, spherical, partial spherical, and/or cone shape.

mount stage 306, in one example, can be made by different types of materials such as metal, aluminum, copper, nickel, gold, silver, alloy, plastic, polymer, composite, or a combination of aluminum, copper, nickel, gold, silver, alloy, plastic, polymer, and/or composite. Depending on the applications, mount stage 306 can be coated with white coating or metallic reflective substance for minimizing shadowing effect. Shadowing effect or shadow effect means a user is able to observe a dark or semi-dark image of mount stage 306 when device 300 is lit. It should be noted that shape and size of mount stage 306 as well as location(s) of LED packages 308 mounted may be optimized to achieve omnidirectional illumination.

Device 302 includes a heat sink 206, a shell 102, and a mount stage 366 wherein mount stage 366 is able to house multiple LED packages 358 and reflectors 360. Note that device 302 may include additional elements such as a base for coupling to a power supply and posts 362 for anchoring reflectors 360. Device 302 contains similar elements as device 300 and performs similar functions as device 300 except that device 302 employs a different type of mount stage 366.

Mount stage 366, in one aspect, is configured to house multiple LED packages 358 wherein in front of each LED package 358 anchors a light reflector 360. Light reflector 360 for example redistributes or spreads at least a portion of directional light generated by an LED package into multidirectional light beams. The shape of mount stage 366, in one example, can be a cylindrical tube, square tube, hexagon tube, octagon tube, spherical shaped tube, or the like. The sizes and locations of light reflectors 360 are adjusted to achieve omnidirectional illumination in accordance with LM79 specifications.

Figure 4:
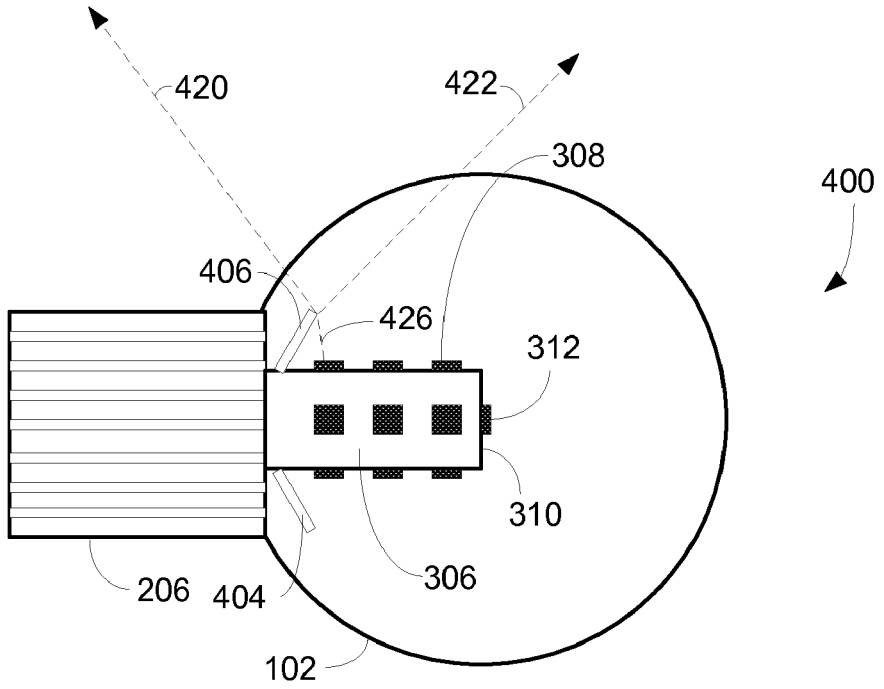
Figure 4:
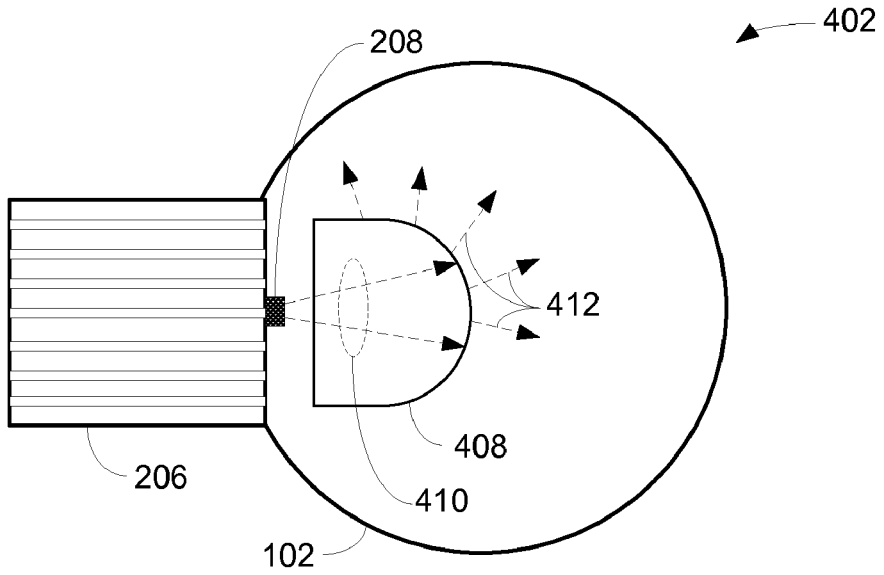

FIG. 4 illustrates side-view diagrams of lighting device 400-402 capable of providing omnidirectional illumination using one or more LED packages in accordance with one aspect of the present invention. Device 400 includes a heat sink 206, a shell 102, and a mount stage 306 wherein mount stage 306 is able to house multiple LED packages 308. Device 400 contains similar elements as device 300 and delivers similar functions as device 300 (illustrated in FIG. 3) except that device 400 employs a set of light reflectors 404-406 for light spreading.

Light reflector 404 or 406, in one aspect, is configured to be adjacent to mount stage 306 for light redistribution. Light reflector 404 is able to deflect at least a portion of the forward light cone from directional light to multidirectional light. For example, upon receipt of light beam 426, light reflector 406 deflects a portion of light beam 420 in one direction and another light beam 422 in another direction. It should be noted that sizes and locations of light reflectors 404-406 can be optimized to achieve omnidirectional illumination in accordance with LM79 specifications.

Device 402 also includes a heat sink 206, a shell 102, and an LED package 208, and a light guide 408 wherein light guide 408, in one aspect, is mounted in front of the LED light source. Device 402 may include additional elements such as a base for coupling to a power supply and post(s) for anchoring light guide 408. Device 402 contains substantially similar elements as device 200 (illustrated in FIG. 2) and performs similar functions as device 200 except that device 402 employs a light guide 408. In one aspect, light guide 408 can also be referred to as a lens.

Light guide 408 is placed in front of LED package 208 whereby substantial amount of directional light beams 410 emitted by LED package 208 are captured by light guide 408. Upon receipt of directional light beams 410, light guide 408 redistributes or spreads one or more directional light beams 410 into omnidirectional light. Note that light guide 410 can be an optical lens configured to extract and distribute light.

Light guide 408 can be made of different types of transparent or semitransparent materials, such as glass, plastic, polymer, silicone, etc. In one aspect, at least partial area of light guide 408 is coated with white or metallic reflective substance to enhance light redistribution. Light guide 408 may be transparent or semitransparent. The shape and/or size of light guide 408 can be optimized to achieve omnidirectional illumination in accordance with the LM79 specifications.

Figure 5:
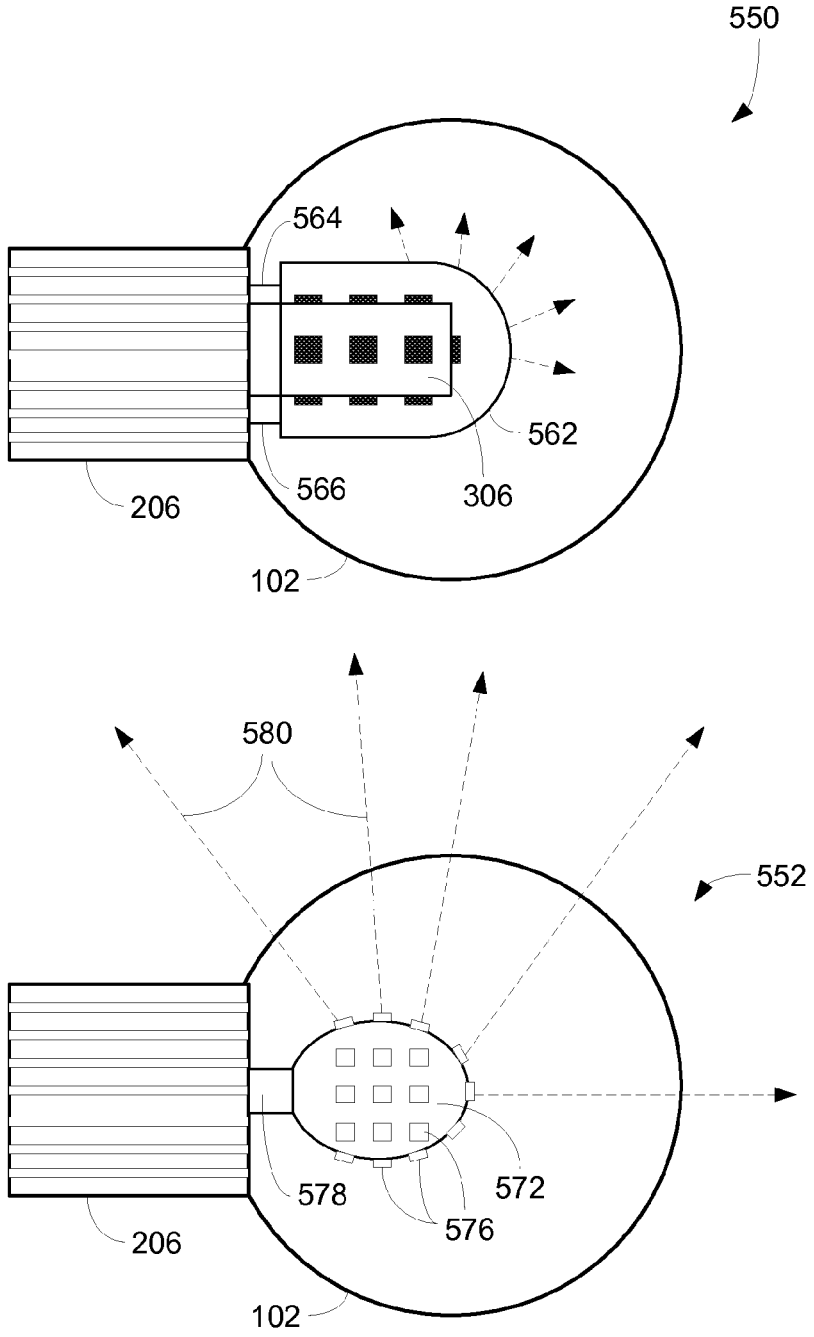

FIG. 5 illustrates side-view diagrams of lighting devices 550-552 capable of providing omnidirectional illumination using one or more LED packages in accordance with one aspect of the present invention. Device 550 includes a heat sink 206, a shell 102, and a mount stage 306, and a light guide 562 wherein mount stage 306, in one aspect, is enclosed in light guide 562. Device 552 may include additional elements such as a base for coupling to a power supply and posts 564-566 for anchoring light guide 562. Device 550 contains substantially similar elements as device 300 (illustrated in FIG. 3) and performs similar functions as device 300 except that device 550 employs a light guide 562 which is similar to light guide 408 for redistributing light.

Light guide 562 envelops mount stage 306 which contains multiple LED packages whereby substantial amount of directional light beams emitted by LED packages are captured by light guide 562. Upon receipt of directional light beams, light guide 562 redistributes or spreads directional light beams into omnidirectional light beams. Light guide or lens, for example, can be made of transparent material, such as glass, plastic, polymer, silicone, etc). Partial area of Light guide can be configured to be coated with white or metallic reflective substance to redistribute light more efficiently. Alternatively, light guide 562 can also be transparent or semitransparent for shadow minimization. It should be noted that the shape and size of light guide 562 can be adjusted and/or optimized to achieve omnidirectional illumination in accordance with the LM79 specifications.

Device 552 includes a heat sink 206, a shell 102, and a spherical tube 572 wherein spherical mount stage 572 is able to house multiple LED packages 576. Device 552 may include additional elements such as a base for coupling to a power supply and a post 578 for anchoring spherical tube 572. In one aspect, post 578 provides a function of heat dissipation by channeling heat from spherical tube 572 to heat sink 206. To facilitate omnidirectional illumination, spherical mount stage 572, in one aspect, is configured to house multiple LED packages 576 in various different angles. Due to the physical shape of spherical mount stage 572, LED packages 576 are mounted in such a way that combined directional light columns 580 generated by LED packages 576 satisfy the requirements of omnidirectional illumination under the LM79 specifications.

Spherical mount stage 572 may be made with different types of materials, such as metal, aluminum, copper, nickel, gold, silver, alloy, plastic, polymer, composite, or a combination of aluminum, copper, nickel, gold, silver, alloy, plastic, polymer, and/or composite. In one example, spherical mount stage 572 is coated with white color, clear color, or metallic reflective substance to minimize shadowing effect. The size of spherical mount stage 572 and location(s) of LED packages mounted can be adjusted and optimized in accordance with the LM79 specifications.

Figure 6:
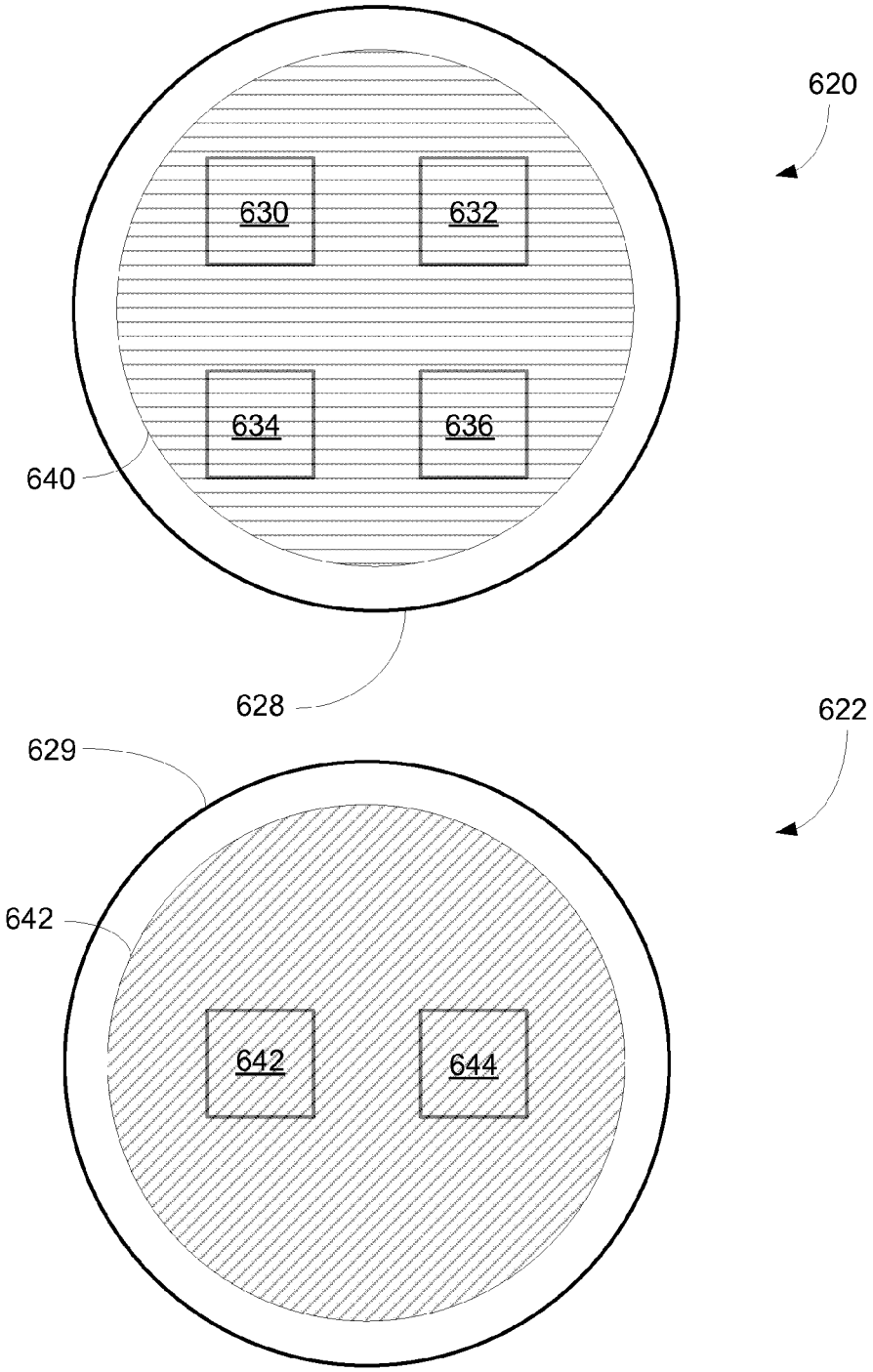
FIG. 6 illustrates two configurations showing layouts of LED packages and reflectors in accordance with one aspect of the present invention.

FIG. 6 illustrates two configurations 620-622 showing layouts of LED packages and reflectors in accordance with one aspect of the present invention. Configuration 620 includes an LED package 628 and a light reflector 640 wherein LED package 628 further includes four (4) LED dies 630-636. During an operation, reflector 640 is configured to receive four (4) directional light beams emitted by LED dies 630-636. When directional light beams strike at the surface of reflector 640, reflector 640 is configured to redistribute or spread the light from the directional light beams to omnidirectional light. It should be noted that reflector 640 can be adjusted if LED package 628 includes more than four (4) LED dies.

Similarly, configuration 622 includes an LED package 629 and a light reflector 642 wherein LED package 629 includes two (2) LED dies 642-644. During an operation, reflector 642 is configured to receive two (2) directional light beams emitted by LED dies 642-644. When directional light beams strike at the surface of reflector 642, reflector 642 is configured to redistribute the light from the directional light beams to omnidirectional light. It should be noted that reflector 642 needs to be adjusted if LED package 628 includes more or less than two (2) LED dies.

Figure 7:
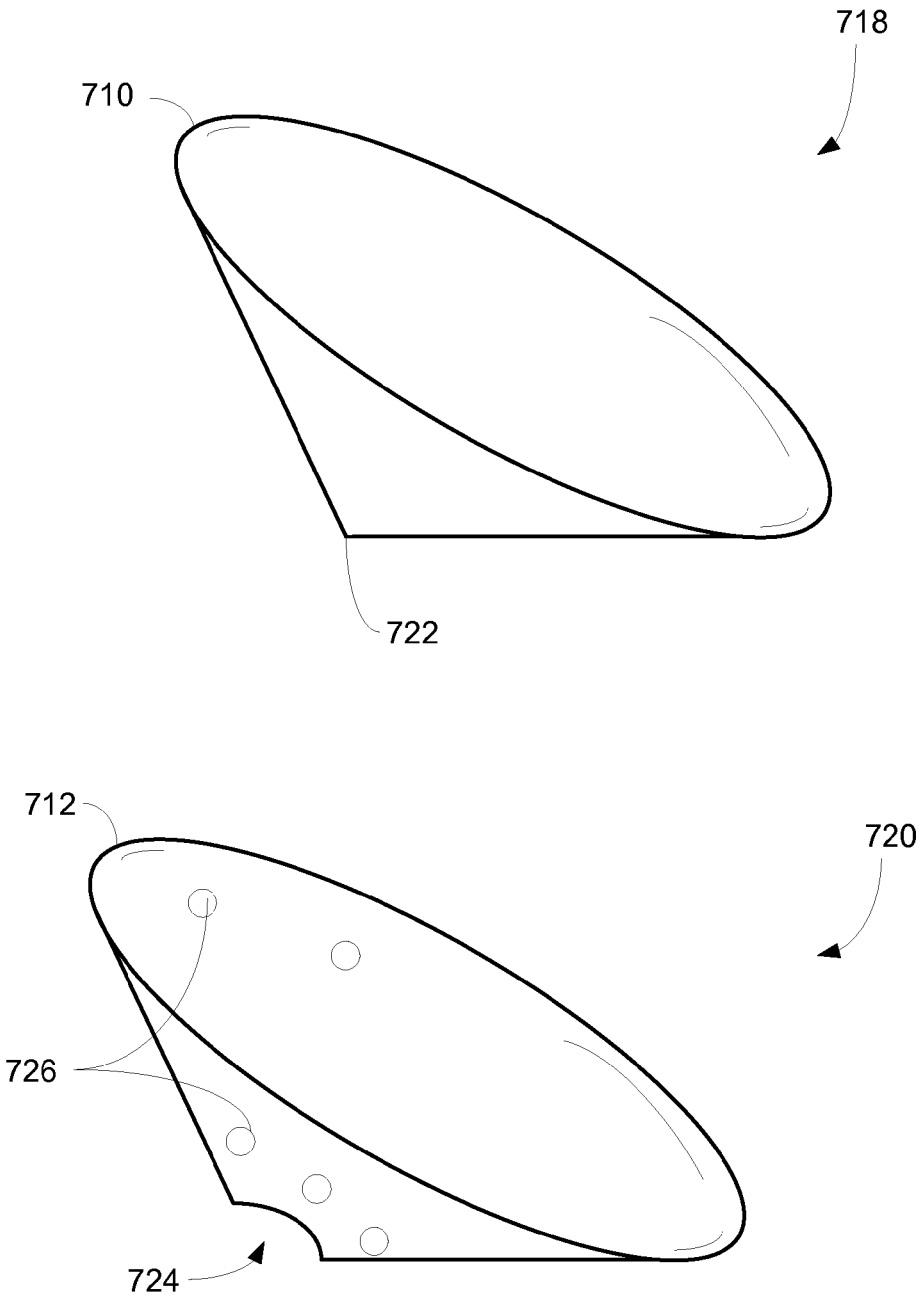
FIG. 7 illustrates cone-shaped lens (or light guide) capable of redistributing at least a portion of forward light cone in accordance with one aspect of the present invention.

FIG. 7 illustrates cone-shaped reflectors 718-720 capable of redistributing at least a portion of forward light cone in accordance with one aspect of the present invention. Reflector 718 shows one aspect of light reflecting apparatus that is formed in a cone shape having a tip 722 and a circular base 710. Depending on the applications, the middle of cone-shaped reflector 718 can be either solid or hollow. Reflector 720 is also a core-shaped reflector having an opening tip 724 and circular base 712. In one aspect, reflector 720 contains many openings or holes 726. A function of hole or opening 724-726 is to allow light to pass through reflector 720 without being deflected. Reflectors 718-720 may be made with transparent or semitransparent materials.

Figure 8A:
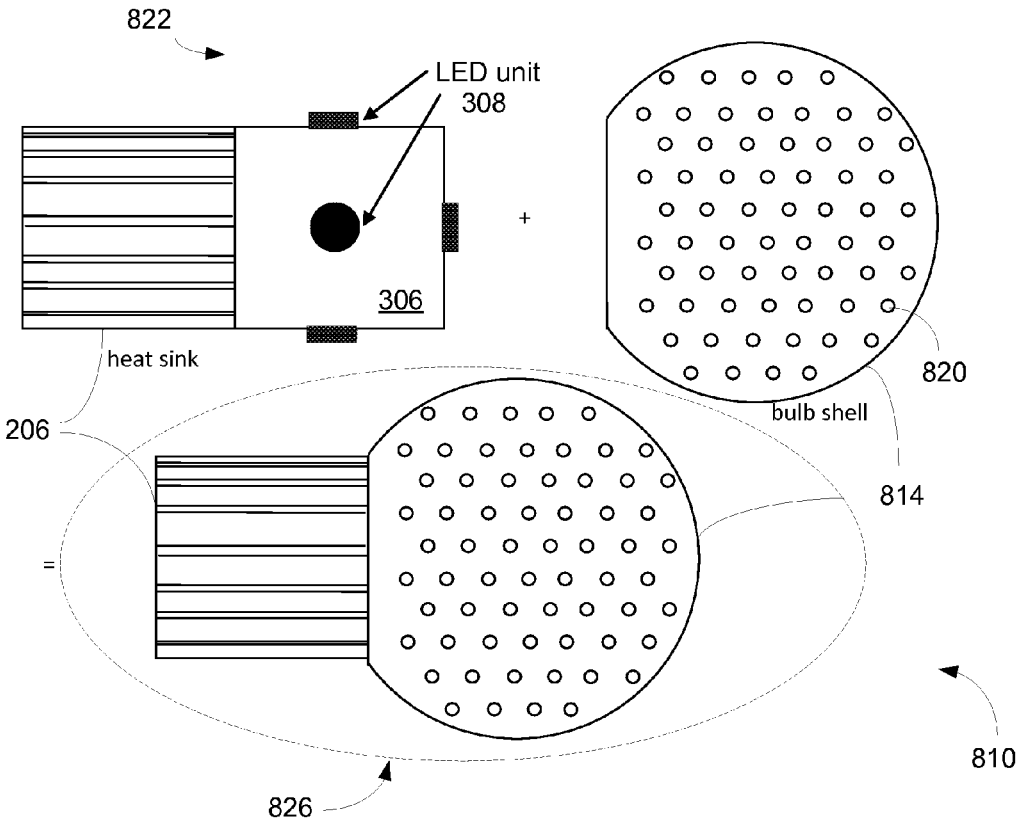
FIGS. 8A-B illustrate alternative configuration of a bulb shell capable of providing omnidirectional illumination and heat dissipation in accordance with one aspect of the present invention.

FIG. 8A illustrates an alternative configuration 810 of a bulb shell capable of providing omnidirectional illumination and heat dissipation in accordance with one aspect of the present invention. Configuration 810 includes a heat sink 206, a mount stage 306, multiple LED packages or units 308, and a bulb shell 814. Bulb shell 814 includes multiple holes or openings 820 for heat dissipation. Mount stage 306 can also be referred to as a substrate. Depending on the arrangement of openings 820, openings 820 can be used to redistribute light.

Note that the density and size of openings 820 can be optimized in accordance with the applications.

Bulb shell 814 is configured to envelop or enclose mount stage 306 which houses multiple LED packages 308. When bulb shell is coupled with sink 206 and mount stage 306, a solid-state light emitting device 826 is formed. The surface of mount stage 306, in one aspect, is coated with white coating or highly reflective coating to deflect light as well as reduce shadowing effect. While fabricated in milky material, bulb shell 814 is partially transmissive and partially reflective.

In one aspect, bulb shell 814 is configured to homogenize directional light generated by LED packages 308 to form omnidirectional light or radiation. A function of openings 820 is to provide air circulation for dissipating excessive heat inside of bulb shell 814. Another function of openings 820 is to redistribute at least a portion of directional light into multidirectional and/or omnidirectional light. Depending on the size of holes or openings 820, bulb shell 814 deflects a portion of light generated by LED packages 308 while allowing a portion of light to pass through shell 814 without deflection. In one aspect, the diameter of opening 820 can be in a range between 0.5 millimeters and 10 millimeters.

Figure 8B:
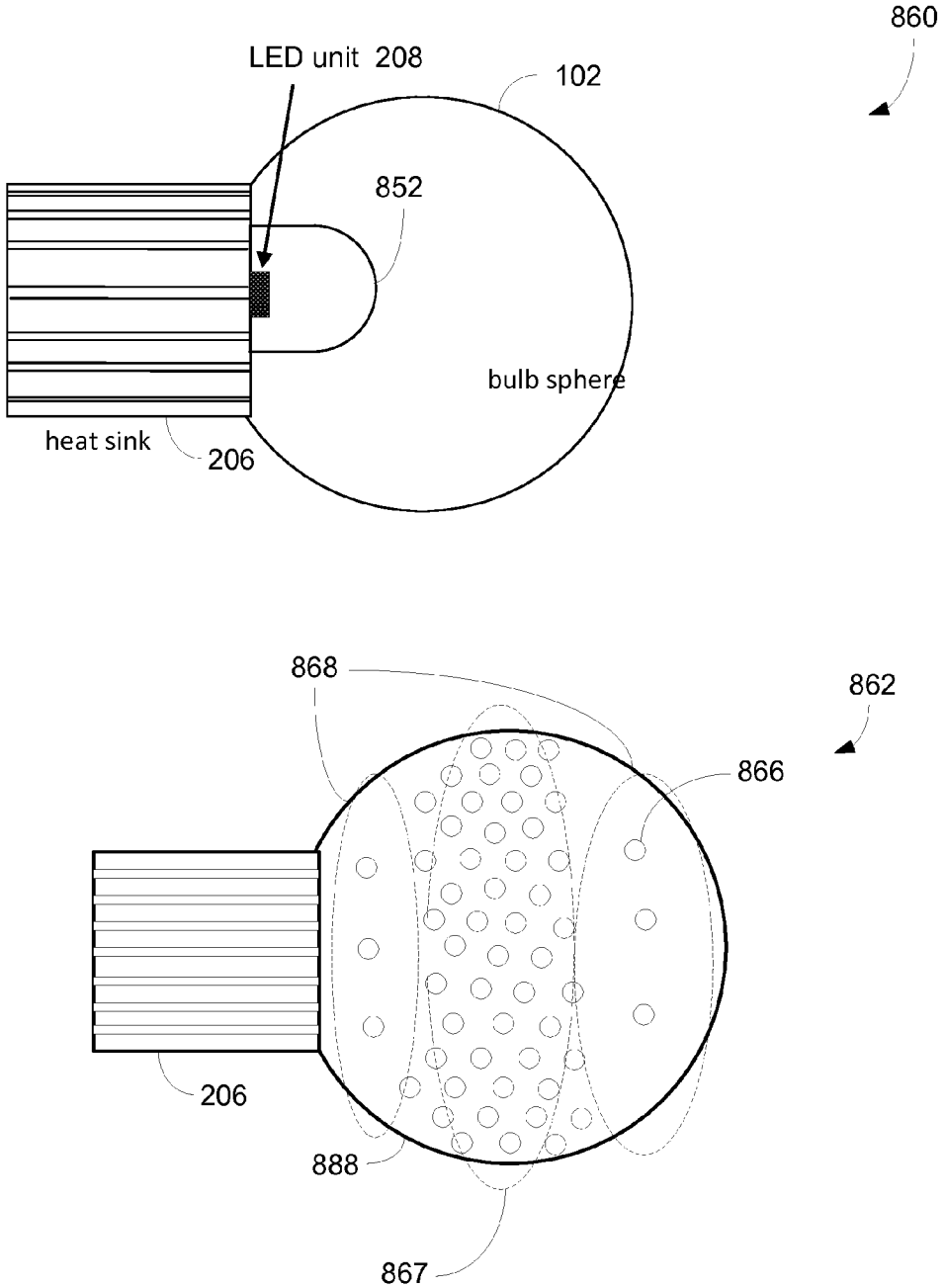

FIG. 8B illustrates side-view diagrams of lighting devices 860-862 capable of providing omnidirectional illumination using one or more LED packages in accordance with one aspect of the present invention. Device 860 includes a heat sink 206, a shell 102, and an LED package 208, and a lens 852 wherein lens 852, in one aspect, is mounted over LED package or unit 208. Lens 852, in one aspect, can also be referred to as a light guide. Device 860 contains substantially similar elements as device 402 as illustrated in FIG. 4 and performs similar functions as device 402 except that device 860 employs lens 852.

Since lens 852 is disposed over LED package 208, it is able to capture directional light beams emitted by LED package 208. Upon receipt of directional light beams, lens 852 redistributes or spreads one or more directional light beams into multidirectional light beams. Lens 852, in one aspect, is made of transparent and/or semitransparent materials, such as glass, plastic, polymer, silicone, etc. Depending on the applications, lens 852 can be clear, white, semi-white, milky color, or metallic reflective substance for shadow minimization.

Device 862 contains substantially similar elements as device 826 as illustrated in FIG. 8A and performs similar functions as device 826 except that device 862 employs a shell 888 having many holes arranged in a unique arrangement. In one aspect, shell 888 contains multiple openings 866 wherein openings 866 are arranged into groups 867-868. For example, group 867 includes more openings 866 with higher density than groups 868. Depending on the applications, device 862 is able to provide omnidirectional radiation by carefully arranging density of openings 866 on shell 888. It should be noted that holes or opening slots are also used for heat dissipation.

Figure 9:
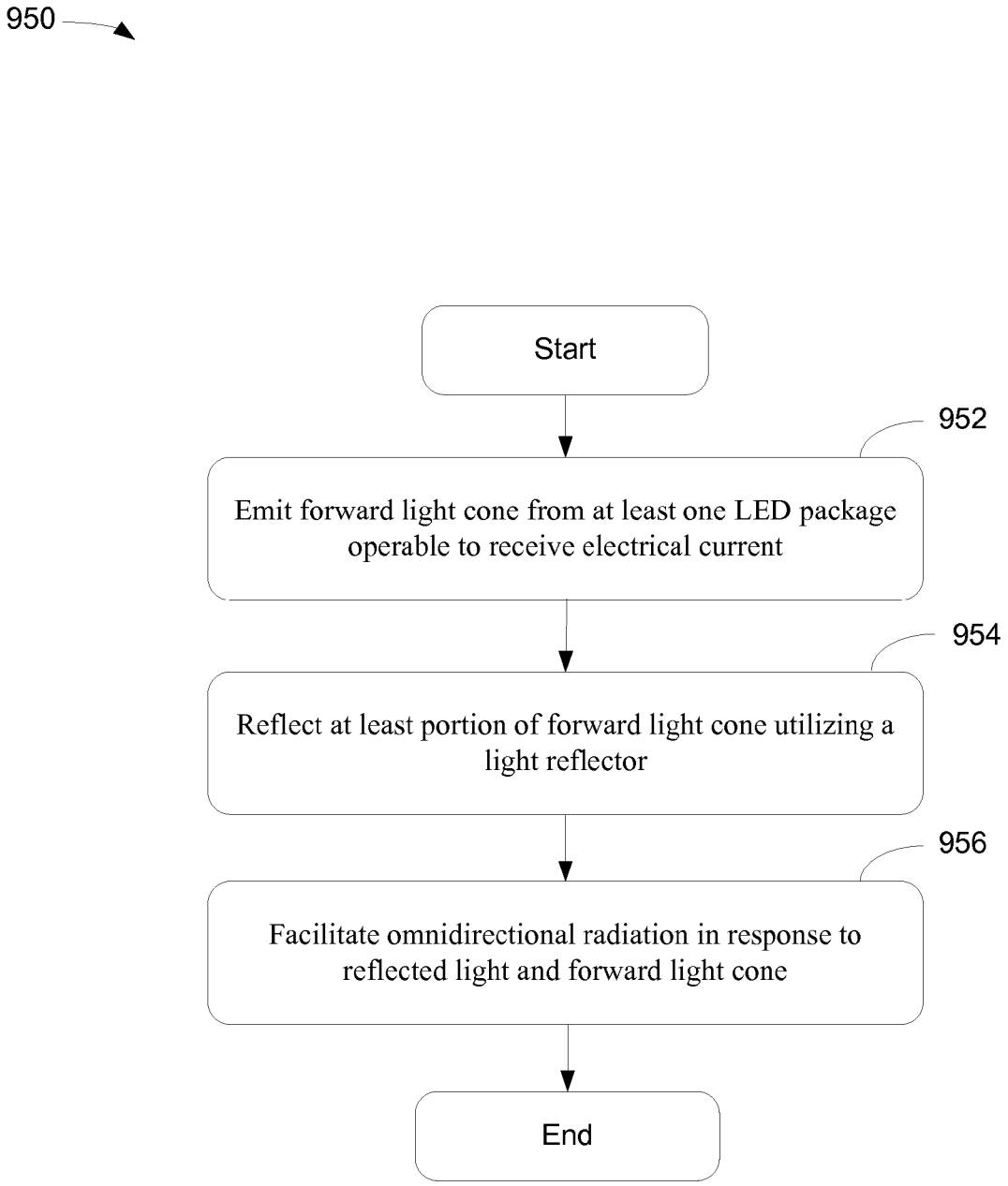
FIG. 9 is a flowchart illustrating a process of generating omnidirectional radiation using one or more reflectors (or lenses, or light guides, or combination of the above) in accordance with one aspect of the present invention.

FIG. 9 is a flowchart 950 illustrating a process of generating omnidirectional radiation using one or more reflectors (or lenses or light guides) in accordance with one aspect of the present invention. At block 952, an LED package which is operable to convert electrical current to optical photons is able to emit or generate a forward light cone or directional light. The LED package, in one example, is mounted on a plate configured to emit a forward light cone. The LED package(s) is enclosed or enveloped by a shell wherein the surface of shell is capable of spreading or converting directional and/or deflected light beams to omnidirectional light columns. In an alternative aspect, the shell has numerous holes and/or slots which can be circular or rectangular openings capable of dissipating thermal heat as well as light redistribution. For example, holes and slots can be carefully arranged whereby they not only provide heat dissipation, but also redistribute light from directional light to omnidirectional light.

At block 954, at least a portion of the forward light cone is reflected or redistributed by a light reflector (or lens or light guide) placed at a location which is on or partially on the light path created by the LED package. For instance, directional light beams are redistributed and/or refined into multidirectional light beams when directional light beams are received at the light reflector (or lens or light guide). A reflector can be formed or fabricated with different size and shape such as a curved reflector or cone shaped reflector for deflecting light.

At block 956, the omnidirectional radiation is generated in response to reflected light and/or forward light cone. A light reflector (or lens or light guide), in one aspect, is configured to be adjacent to the LED package and able to redistribute at least a portion light from the forward light cone to multidirectional light. The process further employs a bulb shell which not only protects LED package, but also facilitates omnidirectional illumination in response to the directional light and deflected light.

Having briefly described aspects of lighting assemblies capable of generating omnidirectional illumination using one or more reflectors (or lenses or light guides) in which the aspect of present invention operates, the following figures illustrate exemplary process and/or method to fabricate and package LED dies, chips, device, and/or fixtures.

Figure 10:
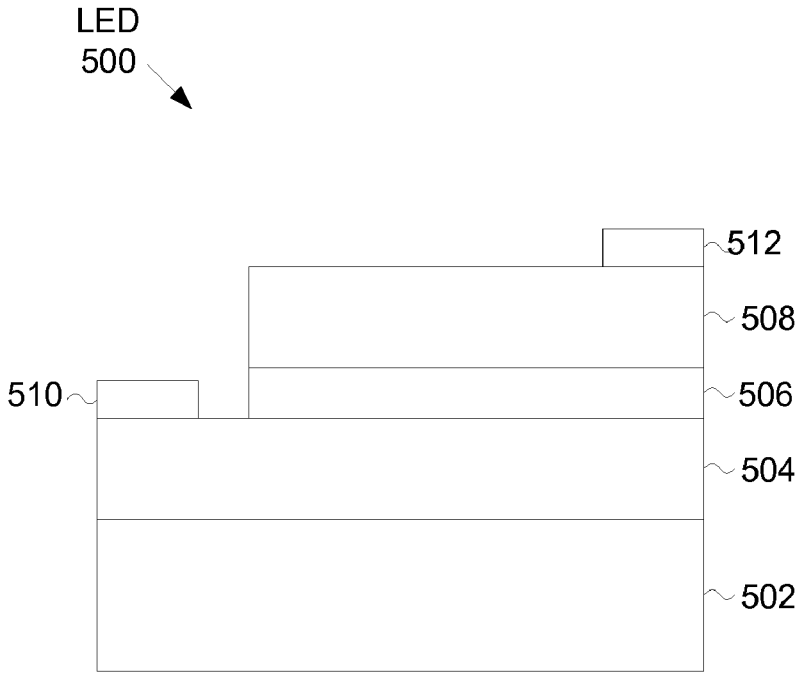
FIG. 10 is a conceptual cross-sectional view illustrating an exemplary fabrication process of an LED or LED devices.

FIG. 10 is a conceptual cross-sectional view illustrating an exemplary fabrication process of an LED or LED devices. An LED is a semiconductor material impregnated, or doped, with impurities. These impurities add "electrons" or "holes" to the semiconductor, which can move in the material relatively freely. Depending on the kind of impurity, a doped region of the semiconductor can have predominantly electrons or holes, and is referred respectively as n-type or p-type semiconductor regions. Referring to FIG. 10, the LED 500 includes an n-type semiconductor region 504 and a p-type semiconductor region 508. A reverse electric field is created at the junction between the two regions, which cause the electrons and holes to move away from the junction to form an active region 506. When a forward voltage sufficient to overcome the reverse electric field is applied across the p-n junction through a pair of electrodes 510, 512, electrons and holes are forced into the active region 506 and recombine. When electrons recombine with holes, they fall to lower energy levels and release energy in the form of light.

In this example, the n-type semiconductor region 504 is formed on a substrate 502 and the p-type semiconductor region 508 is formed on the active layer 506, however, the regions may be reversed. That is, the p-type semiconductor region 508 may be formed on the substrate 502 and the n-type semiconductor region 504 may formed on the active layer 506. As those skilled in the art will readily appreciate, the various concepts described throughout this disclosure may be extended to any suitable layered structure. Additional layers or regions (not shown) may also be included in the LED 500, including but not limited to buffer, nucleation, contact and current spreading layers or regions, as well as light extraction layers.

The p-type semiconductor region 508 is exposed at the top surface, and therefore, the p-type electrode 512 may be readily formed thereon. However, the n-type semiconductor region 504 is buried beneath the p-type semiconductor layer 508 and the active layer 506. Accordingly, to form the n-type electrode 510 on the n-type semiconductor region 504, a cutout area or "mesa" is formed by removing a portion of the active layer 506 and the p-type semiconductor region 508 by means well known in the art to expose the n-type semiconductor layer 504 there beneath. After this portion is removed, the n-type electrode 510 may be formed.

Figure 11:
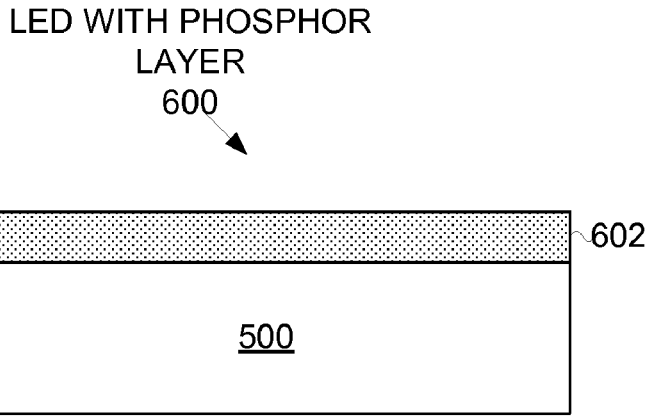
FIG. 11 is a conceptual cross-sectional view illustrating an example of an LED with a phosphor layer.

FIG. 11 is a conceptual cross-sectional view illustrating an example of an LED with a phosphor layer. In this example, a phosphor layer 602 is formed on the top surface of the LED 500 by means well known in the art. The phosphor layer 602 converts a portion of the light emitted by the LED 500 to light having a different spectrum. A white LED light source can be constructed by using an LED that emits light in the blue region of the spectrum and a phosphor that converts blue light to yellow light. A white light source is well suited as a replacement lamp for conventional luminaries; however, the invention may be practiced with other LED and phosphor combinations to produce different color lights. The phosphor layer 602 may include, by way of example, phosphor particles suspended in a carrier or be constructed from a soluble phosphor that is dissolved in the carrier.

Figure 12A:
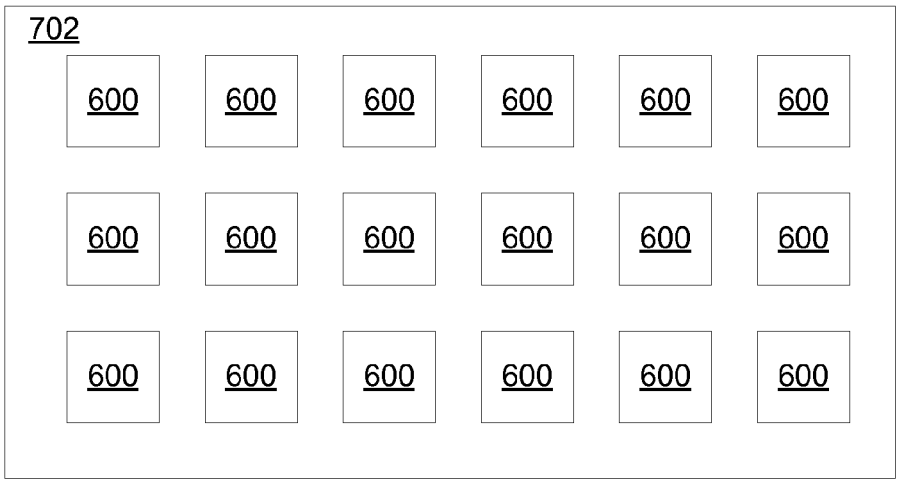
FIG. 12A is a conceptual top view illustrating an example of an LED array that can be used with flexible LED connections in accordance with one aspect of the present invention.
Figure 12B:
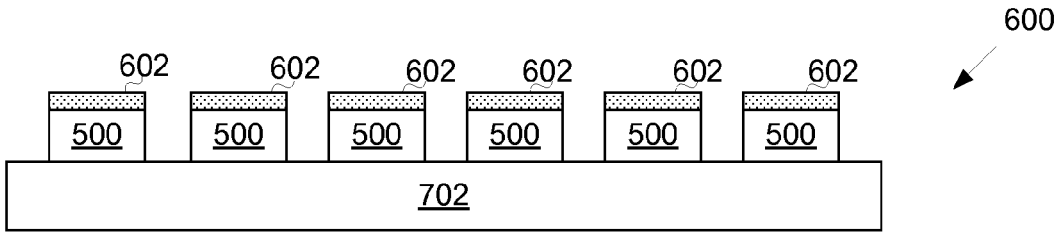
FIG. 12B is a conceptual cross-sectional view of the LED array of FIG. 12A.

In a configuration of LED luminaries, an LED array may be used to provide increased luminance. FIG. 12A is a conceptual top view illustrating an example of an LED array, and FIG. 12B is a conceptual cross-sectional view of the LED array of FIG. 12A. In this example, a number of phosphor-coated LEDs 600 may be formed on a substrate 702. The bond wires (not shown) extending from the LEDs 600 may be connected to traces (not shown) on the surface of the substrate 702, which connect the LEDs 600 in a parallel and/or series fashion. In some aspects, the LEDs 600 may be connected in parallel streams of series LEDs with a current limiting resistor (not shown) in each stream. The substrate 702 may be any suitable material that can provide support to the LEDs 600 and can be mounted within a light fixture (not shown).

Figure 13A:
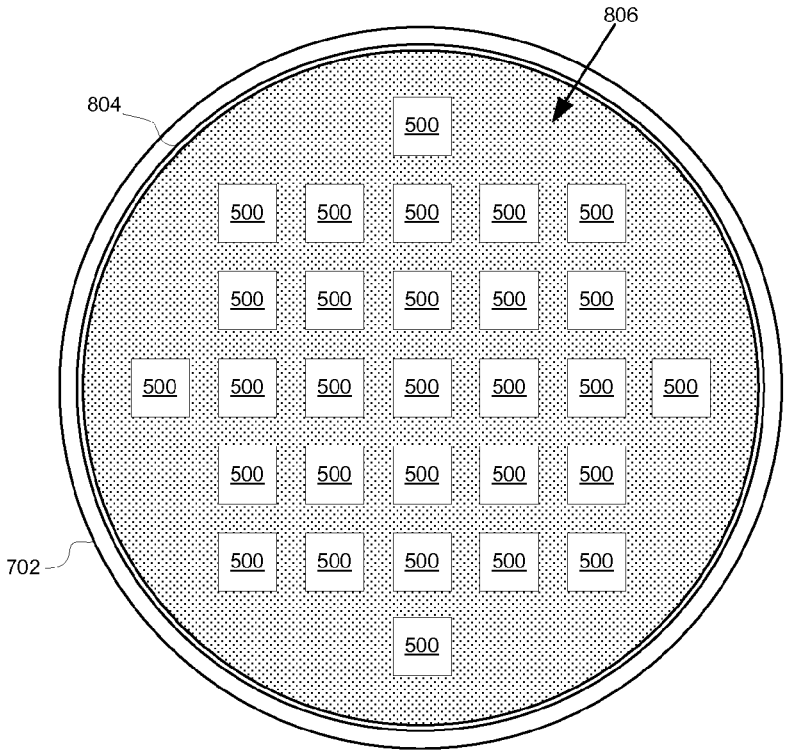
FIG. 13A is a conceptual top view illustrating an example of an alternative configuration of an LED array that can be used with flexible LED connections in accordance with one aspect of the present invention.
Figure 13B:
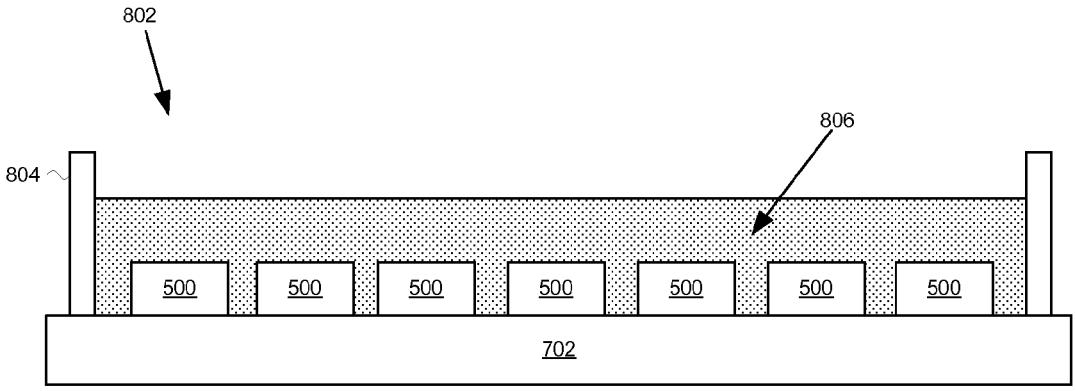
FIG. 13B is a conceptual cross-sectional view of the LED array of FIG. 13A.

FIG. 13A is a conceptual top view illustrating an example of an alternative configuration of an LED array, and FIG. 13B is a conceptual cross-sectional view of the LED array of FIG. 13A. In a manner similar to that described in connection with FIGS. 12A and 12B, a substrate 702 designed for mounting in a light fixture (not shown) may be used to support an array of LEDs 500. However, in this configuration, a phosphor layer is not formed on each individual LED. Instead, phosphor 806 is deposited within a cavity 802 bounded by an annular ring 804 that extends circumferentially around the outer surface of the substrate 702. The annular ring 804 may be formed by boring a cylindrical hole in a material that forms the substrate 702. Alternatively, the substrate 702 and the annular ring 804 may be formed with a suitable mold, or the annular ring 804 may be formed separately from the substrate 702 and attached to the substrate using an adhesive or other suitable means. In the latter configuration, the annular ring 804 is generally attached to the substrate 702 before the LEDs 500, however, in some configurations, the LEDs may be attached first. Once the LEDs 500 and the annular ring 804 are attached to the substrate 702, a suspension of phosphor particles in a carrier may be introduced into the cavity 802. The carrier material may be an epoxy or silicone; however, carriers based on other materials may also be used. The carrier material may be cured to produce a solid material in which the phosphor particles are immobilized.

Figure 14:
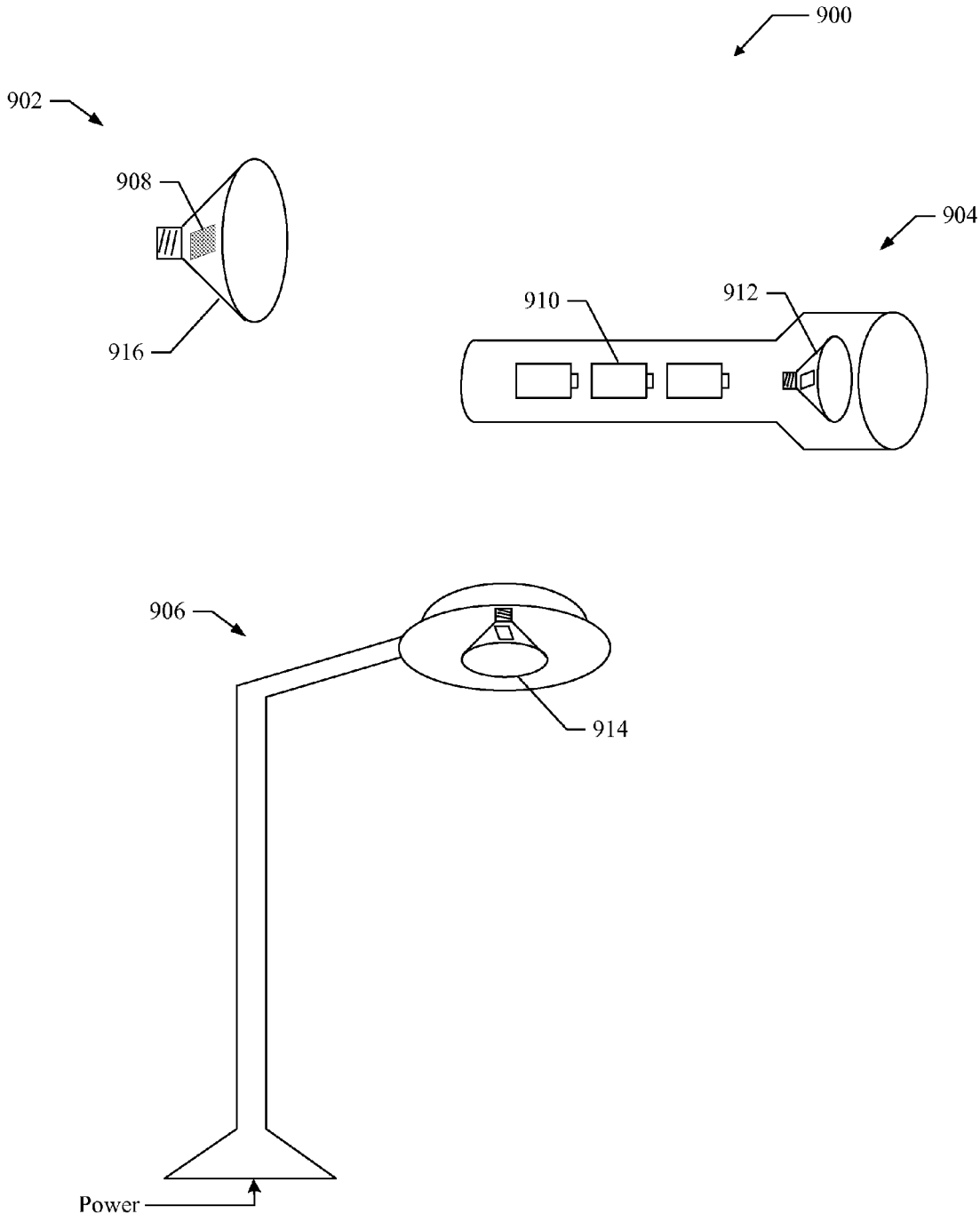
FIG. 14 shows exemplary lighting devices including LED devices using flexible LED connections in accordance with one aspect of the present invention.

FIG. 14 shows exemplary devices including LEDs or LED devices using metal traces in accordance with aspects of the present invention. The devices 900 include a lamp 902, an illumination device 904, and a street light 906. Each of the devices shown in FIG. 14 includes at least an LED or an LED device using metal traces as described herein. For example, lamp 902 includes a package 916 and an LED 908, in which LED 908 employs one or more metal traces to provide flexible connections. Lamp 902 may be used for any type of general illumination. For example, lamp 902 may be used in an automobile headlamp, street light, overhead light, or in any other general illumination application. Illumination device 904 includes a power source 910 that is electrically coupled to a lamp 912, which may be configured as lamp 902. In one aspect, power source 910 may be batteries or any other suitable type of power source, such as a solar cell. Street light 906 includes a power source connected to a lamp 914, which may be configured as lamp 902. It should be noted that aspects of the LED described herein are suitable for use with virtually any type of LED assembly, which in turn may be used in any type of illumination device and are not limited to the devices shown in FIG. 14.

The various aspects of this disclosure are provided to enable one of ordinary skills in the art to practice the present invention. Various modifications to aspects presented throughout this disclosure will be readily apparent to those skilled in the art, and the concepts disclosed herein may be extended to other LED lamp configurations regardless of the shape or diameter of the glass enclosure and the base and the arrangement of electrical contacts on the lamp. Thus, the claims are not intended to be limited to the various aspects of this disclosure, but are to be accorded the full scope consistent with the language of the claims. All structural and functional equivalents to the elements of the various aspects described throughout this disclosure that are known or later come to be known to those of ordinary skills in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A light-emitting device, comprising:

a light emitting diode ("LED") package mounted on a plate and configured to produce a forward light cone;

a light reflector structured in a cone shape with a tip and a circular base and configured to be situated in a light path of the forward light cone generated by the LED package, wherein the tip of the light reflector is situated closer to the LED package than the circular base for redistributing at least a first portion of the forward light cone; and a shell configured to house the LED package and the light reflector, and configured to illuminate light in omnidirectional radiation in response to the forward light cone;

wherein the light reflector comprises a plurality of openings configured to pass a second portion of the forward light cone through the light reflector.

2. The device of claim 1, wherein the LED package includes a solid-state light emitter capable of converting electrical energy to optical photons.

3. The device of claim 1, further comprising a post coupled to the plate and configured to secure the light reflector in front of the LED.

4. The device of claim 3, wherein the post is configured to channel heat inside of the shell to a heat sink.

5. The device of claim 1, wherein the plate couples to an electrical driver and a heat sink.

6. The device of claim 1, wherein the forward light cone includes a column of light with angles travels away from the LED package.

7. The device of claim 6, wherein the light reflector is placed at a location which is at least partially on a path of the forward light cone.

8. The device of claim 7, wherein the light reflector is made of metal materials.

9. The device of claim 7, wherein the light reflector is coated with highly reflective coating.

10. The device of claim 1, wherein the shell protects LED package and the light reflector.

11. The device of claim 1, wherein the shell facilitates redistribution of light from the forward light cone to omnidirectional light in accordance with specification of Luminous Flux Measurement ("LM") 79.

12. A method for generating light from a solid-state light emitting device, comprising:

emitting a forward light cone from at least one light emitting diode ("LED") package operable to convert electrical current to optical photons;

redistributing at least a first portion of the forward light cone by exposing a tip of a cone-shaped light reflector to the first portion of the forwarded light cone;

passing through the light reflector a second portion of the forward light by positioning a plurality of openings of the light reflector in the path of the second portion of the forward light;

reflecting at least a third portion of the forward light cone to an inside surface of a bulb shell utilizing the cone-shaped light reflector situated in a location which is at least partially on a light path generated by the LED package; and facilitating omnidirectional radiation in response to reflected light and the forward light cone.

13. The method of claim 12, further comprising anchoring the cone-shaped light reflector by a post in a path of the forward light cone for redistributing light.

14. The method of claim 13, further comprising protecting the LED package and the cone-shaped light reflector by utilizing a bulb shell.

15. The method of claim 14, further comprising placing a light guide capable of enveloping the LED package for facilitating omnidirectional radiation.

16. A street light, comprising:

a structure coupled to a power source; and a lamp coupled to the structure and including:

a light emitting diode ("LED") package mounted on a plate and configured to produce a forward light cone;

a light reflector structured in a cone shape with a tip and a circular base and configured to be situated in a light path of the forward light cone generated by the LED package, wherein the tip of the light reflector is situated closer to the LED package than the circular base for redistributing at least a first portion of the forward light cone; and a shell housing the LED package and the light reflector, and configured to illuminate light in omnidirectional radiation in response to the forward light cone;

wherein the light reflector comprises a plurality of openings configured to pass a second portion of the forward light cone through the light reflector.

17. The street light of claim 16, further comprising a post coupled to the plate and configured to secure the light reflector in front of the LED package.

18. The street light of claim 17, wherein the LED package includes multiple LED dice.

19. The street light of claim 16, wherein the forward light cone includes a column of light with angles travels away from the LED package.

20. The street light of claim 19, wherein the light reflector is secured in a path of the forward light cone.

* * * * *